US009657461B2

(12) United States Patent
Hashimoto

(10) Patent No.: US 9,657,461 B2
(45) Date of Patent: May 23, 2017

(54) HYDRAULIC CIRCUIT FOR CONSTRUCTION MACHINE AND CONTROL DEVICE FOR SAME

(71) Applicant: SUMITOMO(S.H.I) CONSTRUCTION MACHINERY CO., LTD., Tokyo (JP)

(72) Inventor: Hirofumi Hashimoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 302 days.

(21) Appl. No.: 14/540,226

(22) Filed: Nov. 13, 2014

(65) Prior Publication Data

US 2015/0068200 A1 Mar. 12, 2015

Related U.S. Application Data

(63) Continuation of application No. PCT/JP2013/060962, filed on Apr. 11, 2013.

(30) Foreign Application Priority Data

Aug. 7, 2012 (JP) ..... 2012-175170

(51) Int. Cl.
*F15B 11/00* (2006.01)
*E02F 9/22* (2006.01)
(Continued)

(52) U.S. Cl.
CPC ..... *E02F 9/2282* (2013.01); *E02F 9/2228* (2013.01); *E02F 9/2242* (2013.01);
(Continued)

(58) Field of Classification Search
CPC ..... E02F 9/2228; E02F 9/2242; E02F 9/2267; E02F 9/2282; E02F 9/2285; E02F 9/2292;
(Continued)

(56) References Cited

U.S. PATENT DOCUMENTS 5,115,835 A 5/1992 Ueno
5,673,558 A 10/1997 Sugiyama et al.
(Continued)

FOREIGN PATENT DOCUMENTS

EP 0533953 3/1993
JP S61-31535 2/1986
(Continued)

OTHER PUBLICATIONS

International Search Report mailed on May 14, 2013.

*Primary Examiner* — Logan Kraft
(74) *Attorney, Agent, or Firm* — IPUSA, PLLC

(57) ABSTRACT

A hydraulic circuit for a construction machine including a center bypass passage including a group of directional control valves arranged in tandem; and a bleed-off valve arranged in the center bypass passage on a downstream side of the group, wherein each directional control valve includes a first internal passage causing the pressurized oil supplied to the directional control valve to flow out to the center bypass passage and a second internal passage supplying the pressurized oil to a cylinder port, wherein a parallel passage is formed by the center bypass passage and the first internal passage by causing the pressurized oil discharged from the hydraulic pump to flow to the center bypass passage on the downstream of the directional control valve, wherein the second internal passage supplies the pressurized oil from the center bypass passage through an opening of a spool and/or the bypass passage to the cylinder port.

5 Claims, 10 Drawing Sheets

(51) Int. Cl.
*F15B 11/16* (2006.01)
*F15B 13/04* (2006.01)

(52) U.S. Cl.
CPC ..... *E02F 9/2267* (2013.01); *E02F 9/2285* (2013.01); *E02F 9/2292* (2013.01); *E02F 9/2296* (2013.01); *F15B 11/00* (2013.01); *F15B 11/16* (2013.01); *F15B 13/0402* (2013.01); *F15B 2211/255* (2013.01); *F15B 2211/3052* (2013.01); *F15B 2211/3056* (2013.01); *F15B 2211/30525* (2013.01); *F15B 2211/30595* (2013.01); *F15B 2211/3157* (2013.01); *F15B 2211/327* (2013.01); *F15B 2211/40515* (2013.01); *F15B 2211/41554* (2013.01); *F15B 2211/45* (2013.01); *F15B 2211/7142* (2013.01)

(58) Field of Classification Search
CPC ..... E02F 9/2296; F15B 11/00; F15B 11/16; F15B 13/0402; F15B 2211/30525; F15B 2211/3052; F15B 2211/3056; F15B 2211/30595; F15B 2211/3157; F15B 2211/327; F15B 2211/40515; F15B 2211/41554; F15B 2211/45; F15B 2211/7142; F15B 2211/225
See application file for complete search history.

(56) References Cited

U.S. PATENT DOCUMENTS

| | | | | |
|---|---|---|---|---|
| 5,941,155 | A | 8/1999 | Arai et al. | |
| 5,950,430 | A * | 9/1999 | Tohji ..... | E02F 9/123 60/426 |
| 6,619,037 | B1 | 9/2003 | Toyooka et al. | |

FOREIGN PATENT DOCUMENTS

| | | |
|---|---|---|
| JP | H03-219102 | 9/1991 |
| JP | H10-018359 | 1/1998 |
| JP | H10-147959 | 6/1998 |
| JP | H11-107328 | 4/1999 |
| JP | H11-230375 | 8/1999 |
| JP | H11-257302 | 9/1999 |
| JP | 2000-009102 | 1/2000 |
| JP | 2009-228872 | 10/2009 |

* cited by examiner

HYDRAULIC CIRCUIT FOR CONSTRUCTION MACHINE AND CONTROL DEVICE FOR SAME

RELATED APPLICATION

This application is a continuation application filed under 35 U.S.C. 111(a) claiming the benefit under 35 U.S.C. 120 and 365(c) of a PCT International Application No. PCT/JP2013/060962 filed on Apr. 11, 2013, which is based upon and claims the benefit of priority of the prior Japanese Patent Application No. 2012-175170 filed on Aug. 7, 2012, the entire contents of which are incorporated herein by reference.

BACKGROUND

Technical Field

The present invention relates to a hydraulic circuit for a construction machine and a control device for the same.

Description of Related Art

Some construction machines perform a control (a bleed-off control) of returning a part (e.g., an excess) of a pressurized oil discharged from a hydraulic pump to an operating oil tank. In order to perform the bleed-off control, some construction machines have a gap (e.g., a bleed opening) for returning the pressurized oil in a spool of a directional control valve. According to, for example, the construction machine performs the bleed-off control by changing the opening area of the bleed opening.

An exemplary construction machine has multiple bleed openings Sbo in a spool of a directional control valve Vm as illustrated in FIG. 6. At this time, the hydraulic circuit performs the bleed-off control by changing the opening area of the bleed opening Sbo.

SUMMARY

According to the embodiment, there is provided a hydraulic circuit for a construction machine including a center bypass passage, into which a pressurized oil discharged from a hydraulic pump is supplied, including a directional control valve group including a plurality of directional control valves arranged in tandem with the center bypass passage; and a bleed-off valve arranged in the center bypass passage on a downstream side of the directional control valve group, wherein each directional control valve includes a first internal passage for causing the pressurized oil supplied to the directional control valve to flow out to the center bypass passage and a second internal passage for supplying the pressurized oil to a cylinder port, wherein a parallel passage is formed by the center bypass passage and the first internal passage by causing, by the first internal passage, the pressurized oil discharged from the hydraulic pump to flow out to the center bypass passage on the downstream side of the directional control valve, wherein the second internal passage supplies the pressurized oil from the center bypass passage through an opening of a spool and/or the bypass passage to the cylinder port.

DETAILED DESCRIPTION

Figure 7:
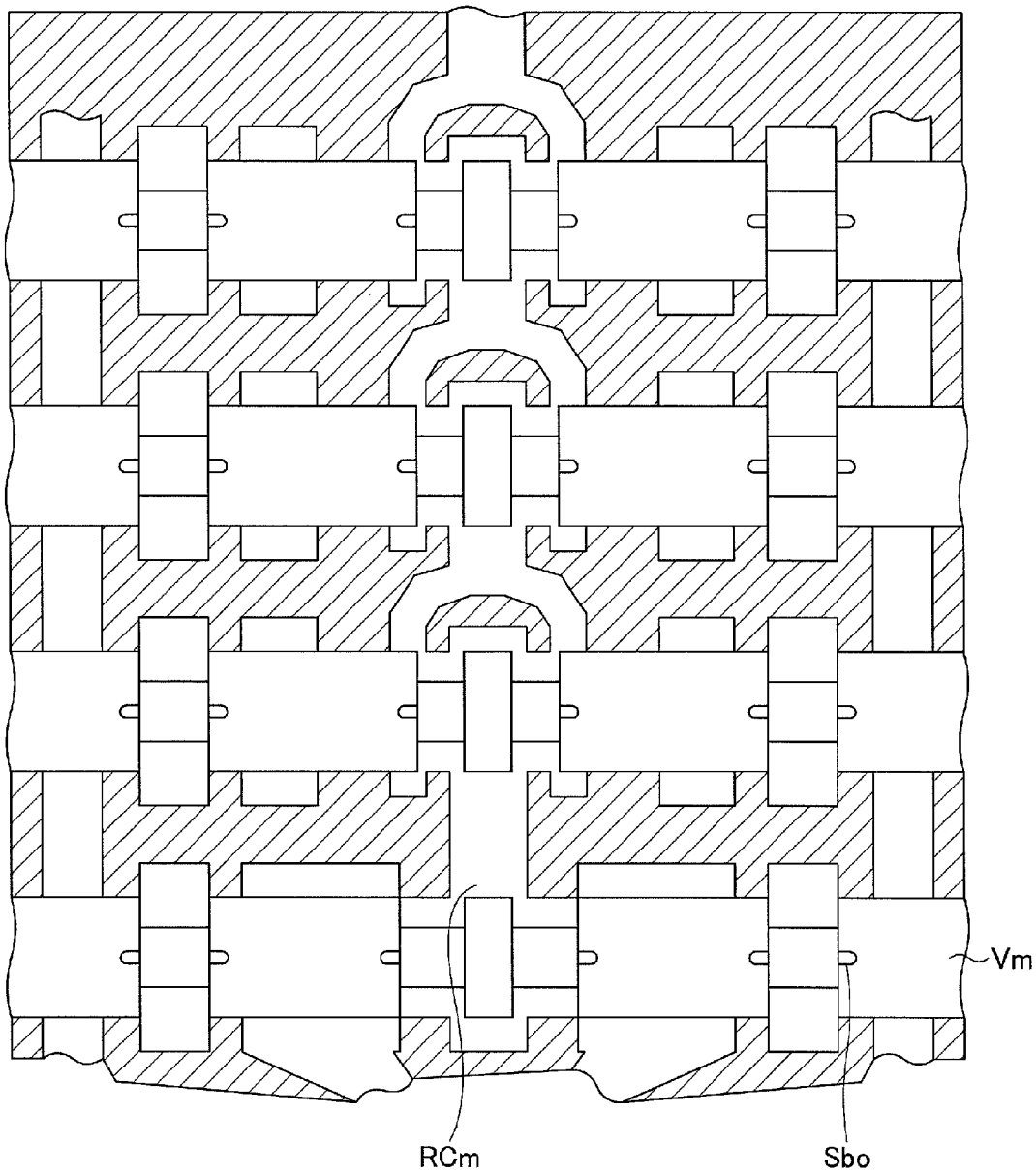
FIG. 7 is a schematic cross-sectional view illustrating a cross-sectional view (taken along a line B-B in FIG. 6) of the directional control valve of the other example of the hydraulic circuit.

However, in the exemplary hydraulic circuit of the construction machine, because the bleed opening is provided to each spool of the multiple directional control valves, there is a case where a pressure loss of the pressurized oil passing through the center bypass passage increases. For example, as illustrated in FIG. 7, because it is necessary to provide multiple bleed openings Sbo in the spools of the multiple directional control valves Vm in the exemplary hydraulic circuit in which multiple directional control valves Nm are arranged, the shape of the center bypass passage RCm becomes complicated (having many curved portions). Therefore, there may be a case where the pressure loss of the pressurized oil passing through the center bypass passage RCm increases.

Further, because the bleed openings are provided in the spools of the multiple directional control valves in the exemplary hydraulic circuit, there may be a case where a pressure loss of the operating oil (the pressurized oil) supplied from the hydraulic pump (the center bypass passage) to a hydraulic actuator (a cylinder port) increases.

Figure 6:
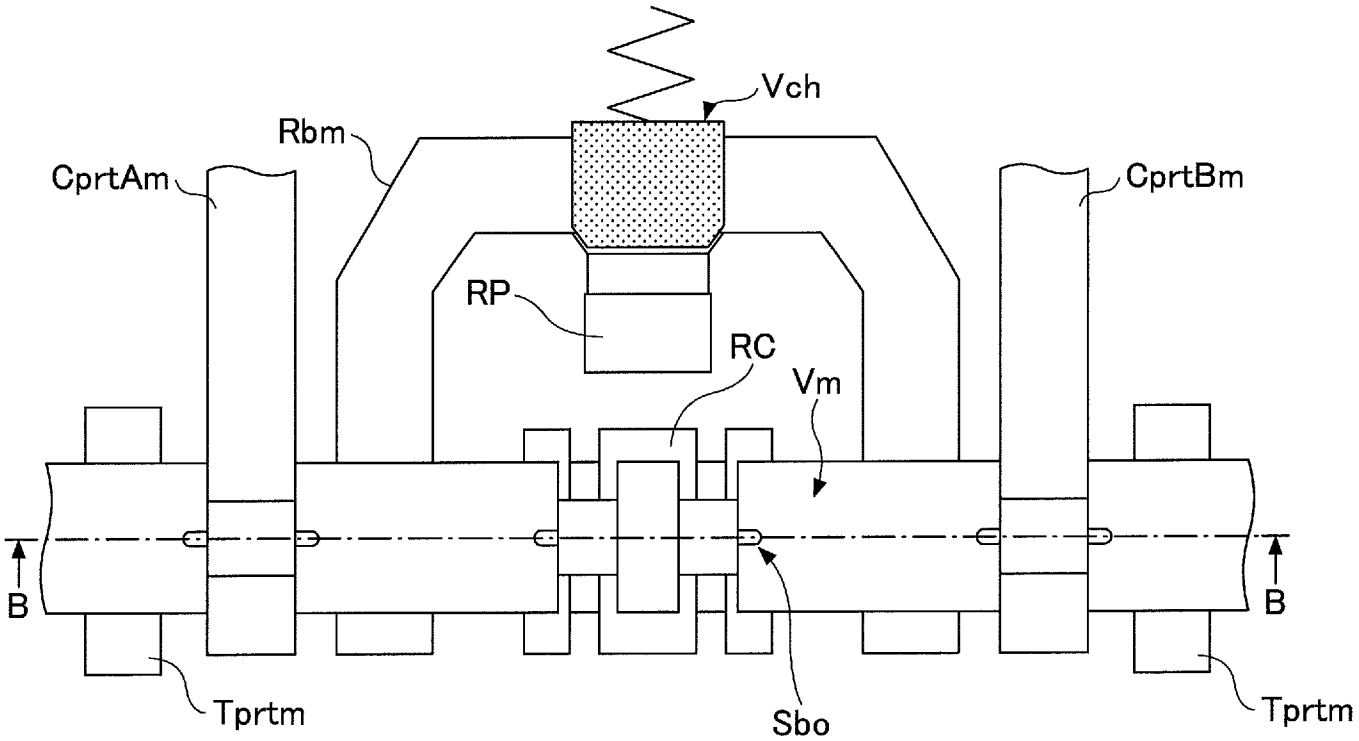
FIG. 6 schematically illustrates the structure of a directional control valve of the other example of the hydraulic circuit of the construction machine.

Further, in a case where a parallel passage (e.g., RP in FIG. 6) is provided in the exemplary hydraulic circuit, when a bypass passage (a bypass switching valve) for bypassing a center bypass passage (RC) and a bypass passage (a bypass switching valve) are further provided, the size of the spool of the directional control valve Vm (or the bridge passage Rbm) may become large in a longitudinal direction of the spool.

An embodiment of the present invention is provided under this situation, and the object of the embodiment is to provide a hydraulic circuit of a construction machine that includes a center bypass passage, into which a pressurized oil discharged from a hydraulic pump is supplied, and performs a bleed-off control and a control device for the same to enable to reduce a pressure loss of a pressurized oil passing through the center bypass passage and to reduce a pressure loss of a pressurized oil supplied to a cylinder port.

There is provided a hydraulic circuit for the construction machine wherein a bypass switching valve arranged in the bypass passage, wherein the bypass switching valve can control a flow rate of the pressurized oil supplied to the cylinder port through the bypass passage by changing an opening area of the bypass switching valve.

Further, there is provided the hydraulic circuit for the construction machine, wherein a passage area of the first internal passage may be substantially unchanged regardless of a position of the spool of each directional control valve and can form the parallel passage corresponding to the passage area, wherein the pressurized oil may be supplied to the plurality of directional control valves only from the parallel passage.

Further, according to the embodiment, there is provided the hydraulic circuit for the construction machine, wherein the directional control valve group includes a plurality of directional control valve groups, and the center bypass passage may include a plurality of center bypass passages, wherein the plurality of directional control valve groups may be arranged in the plurality of center bypass passages, respectively, wherein a plurality of parallel passages may be formed by the plurality of center bypass passages and the first internal passages of the plurality of the directional control valve groups, respectively.

Further, according to the embodiment, there is provided a control device for controlling a hydraulic circuit for a construction machine, wherein the hydraulic circuit for the construction machine may be one of the above hydraulic circuits for the construction machine.

Further, there is provided a control device for controlling a hydraulic circuit for a construction machine, wherein the opening area of the bypass switching valve may be changed in response to operation information input into the construction machine.

According to the hydraulic circuit of the construction machine of the embodiment of the present invention and the control device for the construction machine, it is possible to reduce the pressure loss of the pressurized oil passing through the center bypass passage and the pressure loss of the pressurized oil supplied to the cylinder port.

With reference to the figures, description is given below of non-limiting embodiments of the present invention. In all the figures attached thereto, the same or corresponding reference symbols are attached to the same or corresponding members and parts, and description of overlapping explanation is omitted. Further, relative ratios among the members and parts are not considered in the figures. Therefore, specific dimensions can be determined by a person ordinarily skilled in art in light of the non-limiting embodiments described below.

Hereinafter, a construction machine 100 including a hydraulic circuit 20 of the embodiment of the present invention is used in describing the present invention. The present invention is applicable to any construction machine provided with a center bypass passage (a center bypass line) to flow back a part of the pressurized oil using a cut valve (a bleed-off valve, a flow control valve, or the like) other than the construction machine of the embodiment. Further, the construction machine to which the present invention is applicable is a hydraulic shovel, a crane vehicle, a bulldozer, a wheel loader, a dump truck, a pile hammer, a pile extractor, a water jet, mud discharging water processing facilities, a grout mixer, a construction machine for deep foundations, a boring machine, or the like.

(Structure of Construction Machine)

Figure 1:
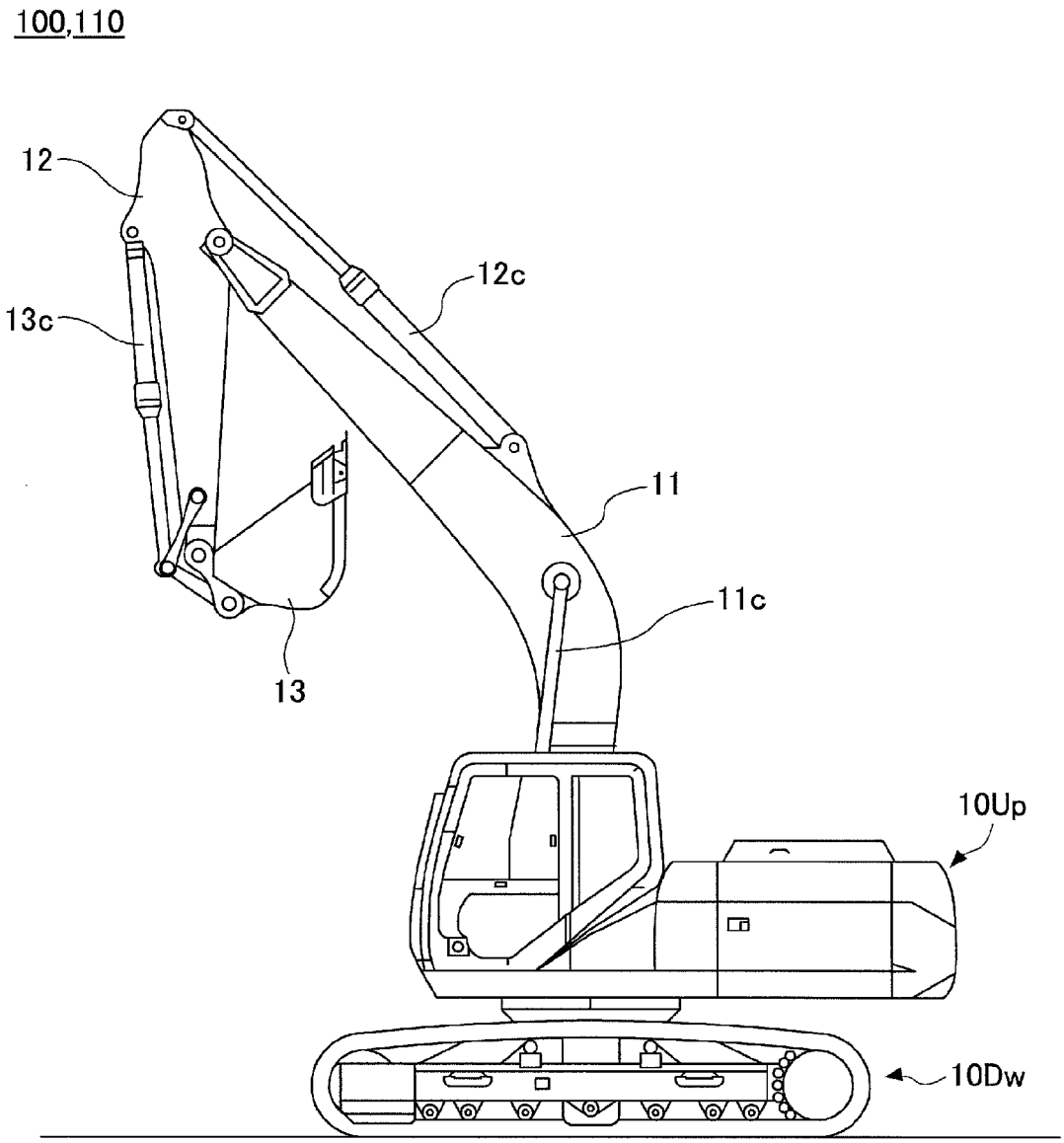
FIG. 1 illustrates a schematic outer appearance for explaining an exemplary construction machine of an embodiment of the present invention.

Referring to FIG. 1, a schematic structure of a construction machine 100, to which the present invention is applicable, is described. Here, the construction machine of the embodiment is a machine performing a desired work using a hydraulic actuator (a boom described later or the like).

Referring to FIG. 1, the construction machine 100 includes hydraulic actuators such as a boom 11 whose base end portion is supported by an upper-part swiveling body 10Up so as to be rotatable, an arm 12 which is supported by a tip end of the boom 11 so as to be rotatable, and a bucket 13 supported by a tip end of the arm 12 so as to be rotatable.

In the construction machine 100, the boom cylinder 11*c* provided in a space between the boom 11 and the upper-part swiveling body 10Up is expanded and contracted in a longitudinal direction of the boom cylinder 11*c* by supplying an operating oil to the boom cylinder 11*c*. At this time, the boom 11 is driven in upward and downward directions by the expansion and contraction of the boom cylinder 11*c*. The construction machine 100 controls the operating oil supplied to the boom cylinder 11*c* using a directional control valve (e.g., Vb1 and Vb2 of FIG. 2 described later) for the boom which is controlled in response to the operation amount and the operation direction of an operation lever operated by an operator (a driver, a worker). As a result, the construction machine 100 performs a desired work in response to the operation amount or the like of the operation lever operated by the operator.

Further, in the construction machine 100, in a manner similar to the boom 11, the arm 12 and the bucket 13 are driven by expansion and contraction of the arm cylinder 12*c* and a bucket cylinder 13*c*. In the construction machine 100, in a manner similar to the boom cylinder 11*c*, the operating oil supplied to the arm cylinder 12*c* and the bucket cylinder 13*c* is controlled by a directional control valve for the arm (e.g., Va1 and Va2 of FIG. 2) and a directional control valve for the bucket (e.g., Vbk of FIG. 2).

Further, a main body of the construction machine 100 runs (movements in the forward, backward, rightward, and leftward directions) and rotates (a swivel motion) using wheels, a swiveling apparatus, and so on. The construction machine 100 uses a directional control valve for traveling (e.g., Vt1, Vt2, and Vst illustrated in FIG. 2) or the like to cause the construction machine 100 to travel in response to the operation amount of the operation lever operated by the operator.

The construction machine 100, to which the present invention is applicable, further includes a hydraulic circuit 20 (described later) for supplying the operating oil (the pressurized oil) from the hydraulic pump to the hydraulic actuator and a control device 30 (described later) for controlling operations of elements of the construction machine 100. Hereinafter, the hydraulic circuit 20 and the control device 30 of the construction machine 100 of the embodiment are specifically described.

(Hydraulic Circuit of Construction Machine)

Figure 2:
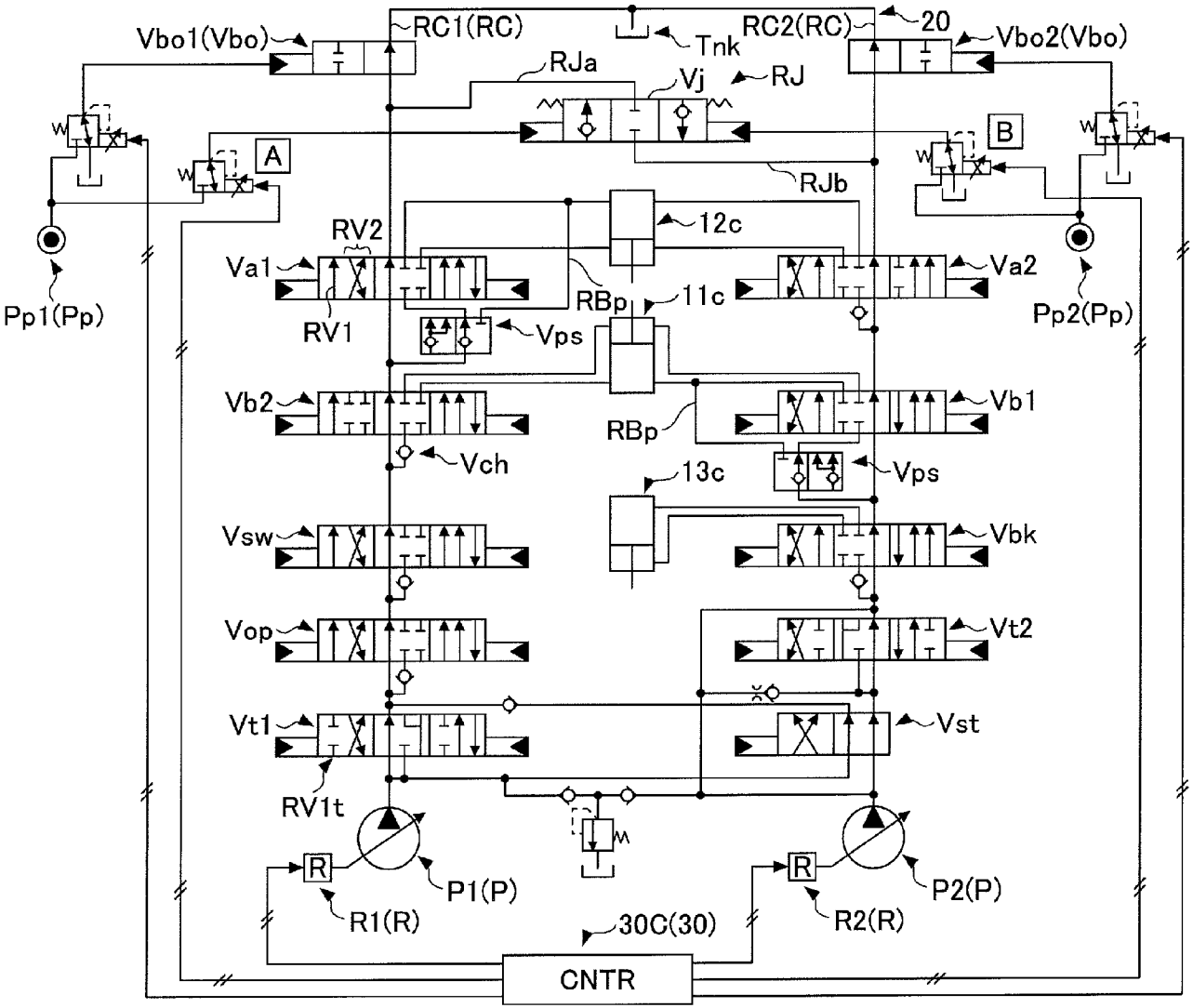
FIG. 2 is a hydraulic circuit diagram for explaining an exemplary hydraulic circuit of the construction machine of the embodiment of the present invention.

Referring to FIG. 2, the hydraulic circuit 20 of the construction machine 100 of the embodiment of the present invention is described. Referring to FIG. 2, solid lines indicate oil passages (passages of the pressurized oil). However, solid lines marked with "//" indicate an electric control system.

The hydraulic circuit, to which the present invention is applicable, is not limited to that illustrated in FIG. 2. Said differently, the present invention is applicable to any hydraulic circuit as long as the hydraulic circuit includes the center bypass passage and is provided with a cut valve in the center bypass passage on the downstream side of the directional control valve. Further, although the hydraulic circuit 20 has two hydraulic pumps, the hydraulic circuit, to which the present invention is applicable, is not limited to that having two hydraulic pumps. Said differently, the present invention is applicable to the hydraulic circuit (the construction machine) having three or more hydraulic pumps.

As illustrated in FIG. 2, the hydraulic circuit 20 of the construction machine 100 of the embodiment of the present invention includes two hydraulic pumps P (first and second hydraulic pumps) mechanically connected to an output shaft of a power source (not illustrated) such as generating machinery, an engine, a motor, or the like, two center bypass passages RC (a first center bypass passage RC1 and a second center bypass passage RC2), into which the pressurized oil (the operating oil) discharged from the two hydraulic pumps P is supplied, respectively, a directional control valve (a first directional control valve Vt1 for travel or the like) for controlling the hydraulic actuator (e.g., the boom 11 or the like), and a directional control valve (a straight travel valve) Vst for straight travel. Further, the hydraulic circuit 20 includes a bleed-off valve Vbo (a first bleed-off valve Vbo1 and a second bleed-off valve Vbo2) arranged on the downstream side (for example, the most downstream side) of the center bypass passage RC and a pilot pump Pp (a first pilot pump Pp1 and a second pilot pump Pp2) for generating (discharging the pressurized oil) a pressure input into a pilot port (a control port) of the bleed-off valve Vbo. Further, within the embodiment, the hydraulic circuit 20 further includes a bypass passage RBp for supplying (bypassing) the pressurized oil of the center bypass passage RC to the cylinder port and a bypass switching valve Vps arranged in the bypass passage RBp.

Although the bypass passage RBp (and the bypass switching valve Vps) is arranged on the upstream side of the directional control valve Vb1 for the first boom and the directional control valve Va1 for the first arm in the hydraulic circuit 20 illustrated in FIG. 2, the bypass passage of the hydraulic circuit, to which the present invention is applicable, is not limited to that arranged at these positions. Said differently, the bypass passage (the bypass switching valve) may be arbitrarily provided on the upstream or downstream side of the directional control valve in the hydraulic circuit, to which the present invention is applicable. Further, the bypass switching valve Vps of the hydraulic circuit 20 may be a proportional valve, a proportional control valve, a switch valve, and so on. Further, a load check valve which is previously arranged may be used as the bypass switching valve Vps in the hydraulic circuit 20.

According to the hydraulic circuit 20 of the embodiment, the directional control valves (Vt1 or the like) are arranged in the center bypass passage RC in series, and the bleed-off valve Vbo is arranged in a downstream side of the center bypass passage RC. Specifically, in the hydraulic circuit 20, the center bypass passage RC1 corresponding to the first hydraulic pump P1 includes the first directional control valve Vt1 for travel (e.g., a directional control valve for left travel), an auxiliary directional control valve Vop, a directional control valve Vsw for swivel, the directional control valve Vb2 for a second boom, the directional control valve Va1 for a first arm, and the bleed-off valve Vbo1, which are arranged in series as illustrated in FIG. 2. Further, in the hydraulic circuit 20, the second center bypass passage RC2 corresponding to the second hydraulic pump P2 includes the second directional control valve Vt2 for travel (e.g., a directional control valve for right travel), a directional control valve Vbk for a bucket, the directional control valve Vb1 for a first boom, the directional control valve Va2 for a second arm, and the second bleed-off valve Vbo2, which are arranged in series. Further, the hydraulic circuit 20 is provided with the straight travel valve Vst on the upstream side of the second center bypass passage RC2.

Said differently, in the hydraulic circuit 20, multiple directional control valves are arranged in series in the center bypass passage RC. Further, in the hydraulic circuit 20, the directional control valves are arranged in each of the two center bypass passages RC1 and RC2 in series so that the directional control valves are arranged in tandem. In the following explanation, a group of the multiple directional control valves arranged in tandem in the center bypass passage RC is referred to as a "directional control valve group".

In the hydraulic circuit 20 of the embodiment, a remote control pressure (a secondary pressure of a remote control valve) generated in response to operation information corresponding to an operator's operation of the operation lever (for example, information related to an operation amount) is input into the directional control valve (Vt1 or the like) corresponding to the operated operation lever. At this time, the directional control valve switches the position of the spool in response to the remote control pressure introduced into the both ends of the spool (the flow rate control spool) to change the area of the opening of the spool. With this, the directional control valve can control the flow rate (the operation amount) and the direction (the operation direction) of the pressurized oil (the operating oil) supplied from the center bypass passage RC through the opening of the spool to the hydraulic actuator (e.g., a cylinder port Cprt illustrated in FIGS. 3A to 3C).

Further, in the hydraulic circuit 20 of the embodiment, a part (an excess) of the pressurized oil discharged from the hydraulic pump P (e.g., P1) is flown back to an operating oil tank Tnk (the bleed-off control) using the bleed-off valve Vbo (e.g., Vbo1) that is arranged on the downstream side of the center bypass passage RC (e.g., RC1). With this, in the construction machine 100, the flow rate of the operating oil (the pressurized oil) supplied to the hydraulic cylinder (e.g., 11*c*) is controlled and the drive (the operation) of the hydraulic actuator (e.g., the boom 11 illustrated in FIG. 1) is controlled.

The bleed-off valve Vbo of the embodiment can be set at an unloading position where the opening area of the bleed-off valve Vbo is maximum and a blocking position where the opening area of the bleed-off valve Vbo is zero. The bleed-off valve Vbo is switched from the unloading position to the blocking position using (the pressure of) the pressurized oil of a pilot pump Pp through an electromagnetic proportional electromagnetic pressure reducing valve (not illustrated) or the like controlled by the control device (described later). Thus, the opening area of the bleed-off valve Vbo is changed. With this the bleed-off valve Vbo can flow back (return) the pressurized oil to the operating oil tank at a desirable flow rate corresponding to the changed opening area.

Further, the hydraulic circuit 20 of this embodiment directly supplies a part of the pressurized oil discharged from the hydraulic pump P (P2 or P1) to the cylinder port (Cprt in, for example, FIGS. 3A to 3C) using the bypass passage RBp (and the bypass switching valve Vps) arranged on the upstream side of the directional control valve (e.g., Vb1 or Va1 of FIG. 2). Further, the hydraulic circuit 20 changes the opening area of the bypass switching valve Vps based on information input in the construction machine 100. Said differently, the hydraulic circuit 20 of the embodiment causes the bypass switching valve Vps to function as a load check valve and simultaneously as a switch valve of directly supplying the operating oil (the pressurized oil) to the hydraulic actuator using the bypass passage RBp.

(Directional Control Valve and Internal Passage of Directional Control Valve)

The directional control valve arranged in the hydraulic circuit of the construction machine 100 of the embodiment of the present invention is described with reference to FIGS. 3A-3C and 4.

Figure 3A:
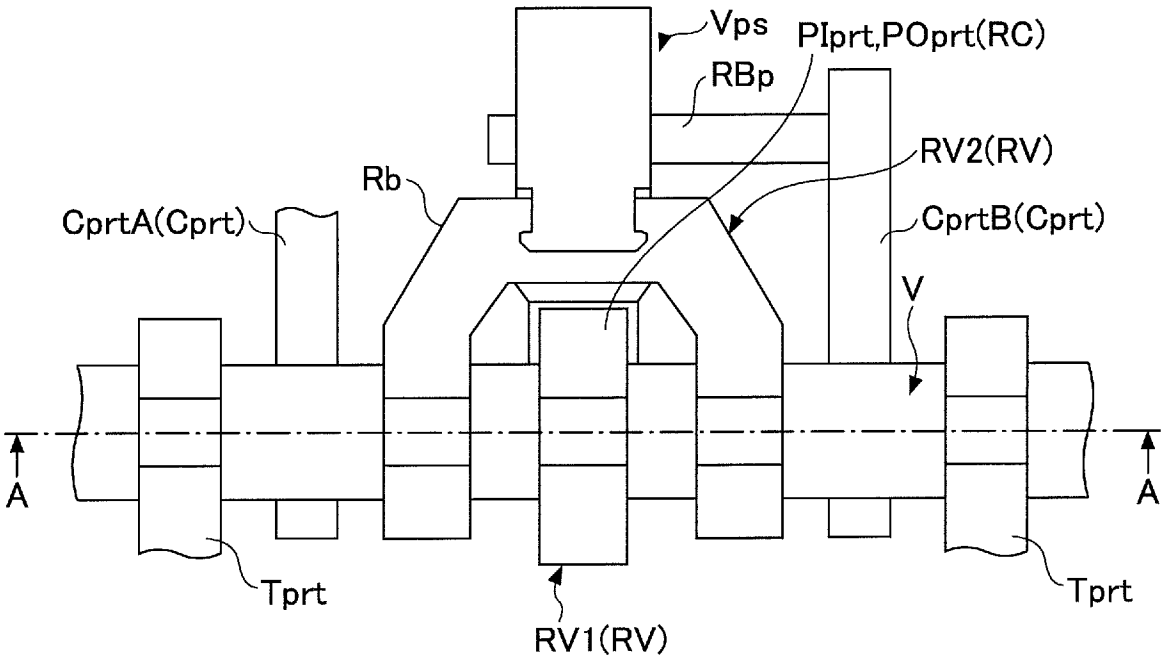
FIG. 3A schematically illustrates an exemplary directional control valve of the hydraulic circuit of the construction machine of the embodiment of the present invention.

Referring to FIG. 3A, the hydraulic circuit 20 of the embodiment includes a directional control valve V controlling the operating oil (the pressurized oil) supplied to the hydraulic actuator (the hydraulic cylinder), an inlet port PIprt supplied with the pressurized oil through the center bypass passage RC, an outlet port POprt flowing the pressurized oil supplied to the inlet port PIprt into the center bypass passage RC, a cylinder port Cprt supplying the pressurized oil to the hydraulic cylinder, and a tank port Tprt ejecting the pressurized oil ejected from the hydraulic cylinder to the operating oil tank.

Figure 4:
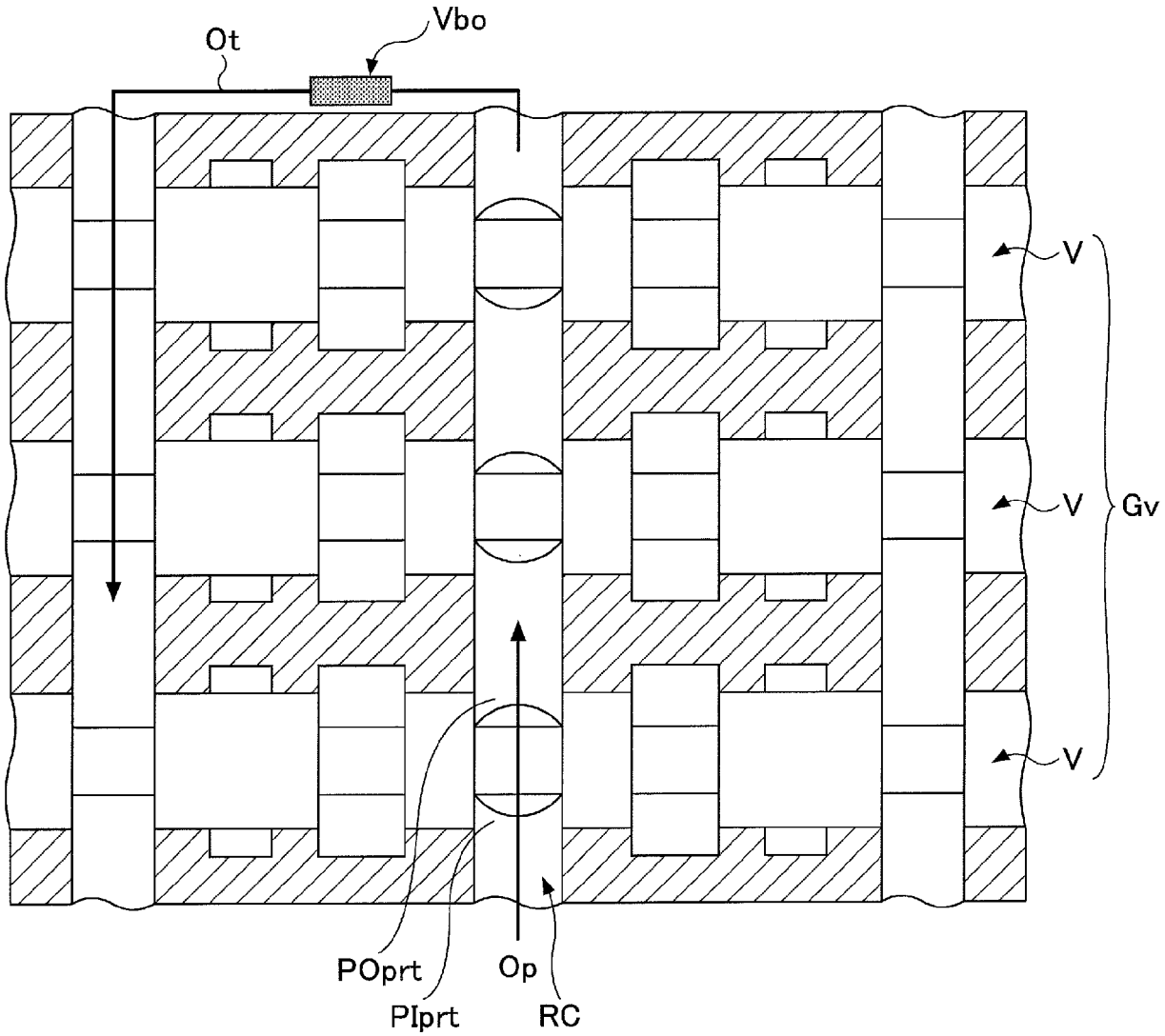
FIG. 4 is a schematic cross-sectional view illustrating an exemplary cross-sectional view (taken along a line A-A in FIGS. 3A-3C) of the hydraulic circuit of the construction machine of the embodiment of the present invention.

Further, the directional control valve of the embodiment includes, as an internal passage RV, a first internal passage flowing the pressurized oil, which is supplied, into the center bypass passage RC and a second internal passage flowing the pressurized oil, which is supplied, into the hydraulic actuator. As illustrated in FIG. 4, the hydraulic circuit 20 of the embodiment includes the directional control valve group Gv formed by multiple directional control valves. Said differently, each of the multiple directional control valves V forming the directional control valve group includes the first internal passage RV1 and the second internal passage RV2.

The first internal passage RV1 of the directional control valve V of the embodiment is an internal passage (e.g., RV1 illustrated in FIG. 2) for supplying the pressurized oil into the center bypass passage RC on a downstream side (e.g., the bleed-off valve Vbo). The first internal passage RV1 flows the pressurized oil discharged from the hydraulic pump P into the downstream side of the center bypass passage RC relative to the directional control valve V. Further, the opening of the first internal passage RV1 is not completely closed in a case where the position of the spool of the directional control valve V is switched over. Said differently, the passage area of the first internal passage RV1 is substantially unchanged regardless of the position of the spool of the directional control valve V.

With this, in the hydraulic circuit 20 of the embodiment of the present invention, a parallel passage can be formed by the center bypass passage RC and the first internal passage RV1. In the hydraulic circuit 20 of the embodiment, the parallel passage corresponding to the passage area of the first internal passage RV1 can be formed. Further, in the hydraulic circuit 20 of the embodiment of the present invention, the pressurized oil can be supplied from only the formed parallel passage to the directional control valve group Gv (the multiple directional control valves V).

Among the multiple directional control valves V, the directional control valve for travel (e.g., Vt1, Vt2 illustrated in FIG. 2) may be structured so that the opening of the first internal passage is completely closed (for example, RV1*t* illustrated in FIG. 2). With this, (the hydraulic circuit 20 of) the construction machine 100 can maintain stability of travel (the flow rate of the operating oil necessary for the travel) during the travel. Further, in the directional control valve V of the embodiment, (the spool of) the first internal passage RV1 is not provided with a gap (hereinafter, a "bleed opening") for returning the pressurized oil to the operating oil tank. In the hydraulic circuit 20 of the embodiment of the present invention, the bleed-off control (a standardized bleed-off control) can be performed using the bleed-off valve Vbo arranged on the most downstream side of the center bypass passage RC as described above.

The second internal passage RV2 of the embodiment of the present invention is the internal passage (e.g., RV2 illustrated in FIG. 2) for supplying the pressurized oil to the hydraulic cylinder (e.g., the arm cylinder 12*c* or the like illustrated in FIG. 2). The second internal passage RV2 supplies the pressurized oil discharged from the hydraulic pump P to the hydraulic cylinder. Further, in a case where the area of the opening of the spool of the directional control valve V changes by the input remote control pressure, the flow rate (the operation amount) and the direction (the operation direction) of the pressurized oil (the operating oil) to be supplied into the second internal passage RV2 are changed. Further, within the embodiment, the second internal passage RV2 supplies a part (or all) of the pressurized oil discharged from the hydraulic pump P directly to the cylinder port Cprt (the hydraulic cylinder) using the bypass passage RBp (and the bypass switching valve Vps).

Figure 3B:
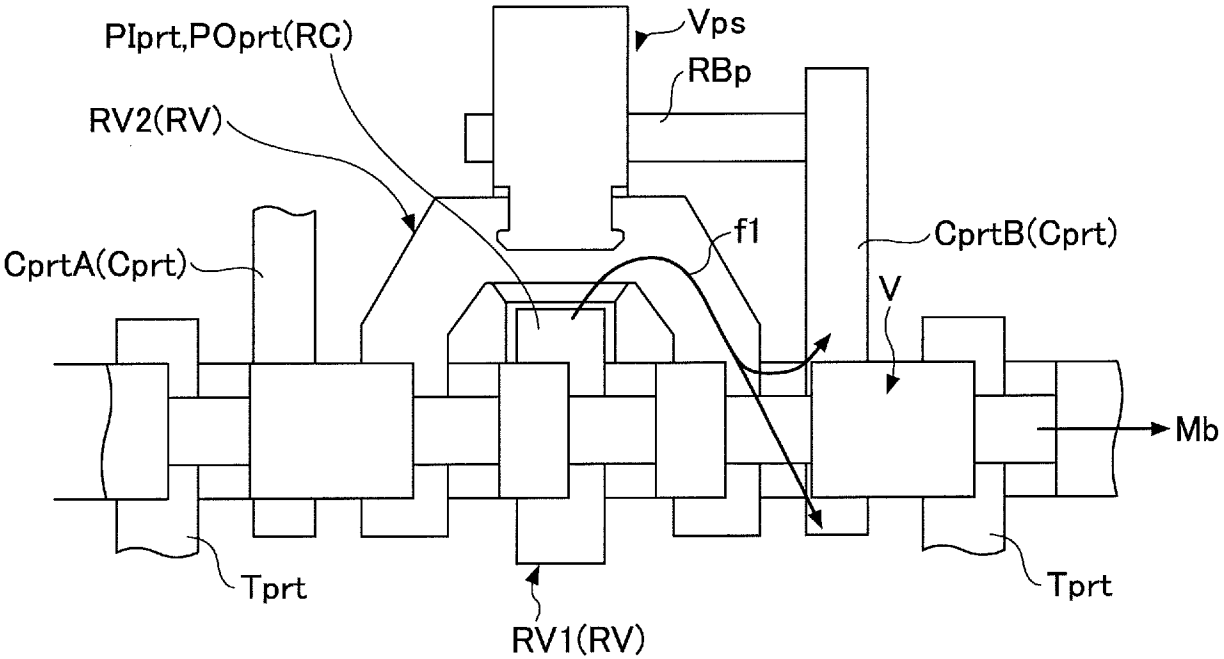
FIG. 3B schematically illustrates an exemplary directional control valve of the hydraulic circuit of the construction machine of the embodiment of the present invention.

Specifically, as illustrated in FIG. 3B, the directional control valve V of the embodiment supplies the pressurized oil (the operating oil) supplied from the center bypass passage RC through the second internal passage RV2 and the opening of the spool (f1 in FIG. 3B) to the cylinder port CprtB (the hydraulic cylinder) when the bypass passage RBp is unavailable (the bypass switching valve Vps is closed) in a case where the spool is displaced (Mb). At this time, the pressurized oil (the operating oil) ejected from the hydraulic cylinder to the cylinder port CprtA is ejected from the tank port Tprt to the operating oil tank.

Figure 3C:
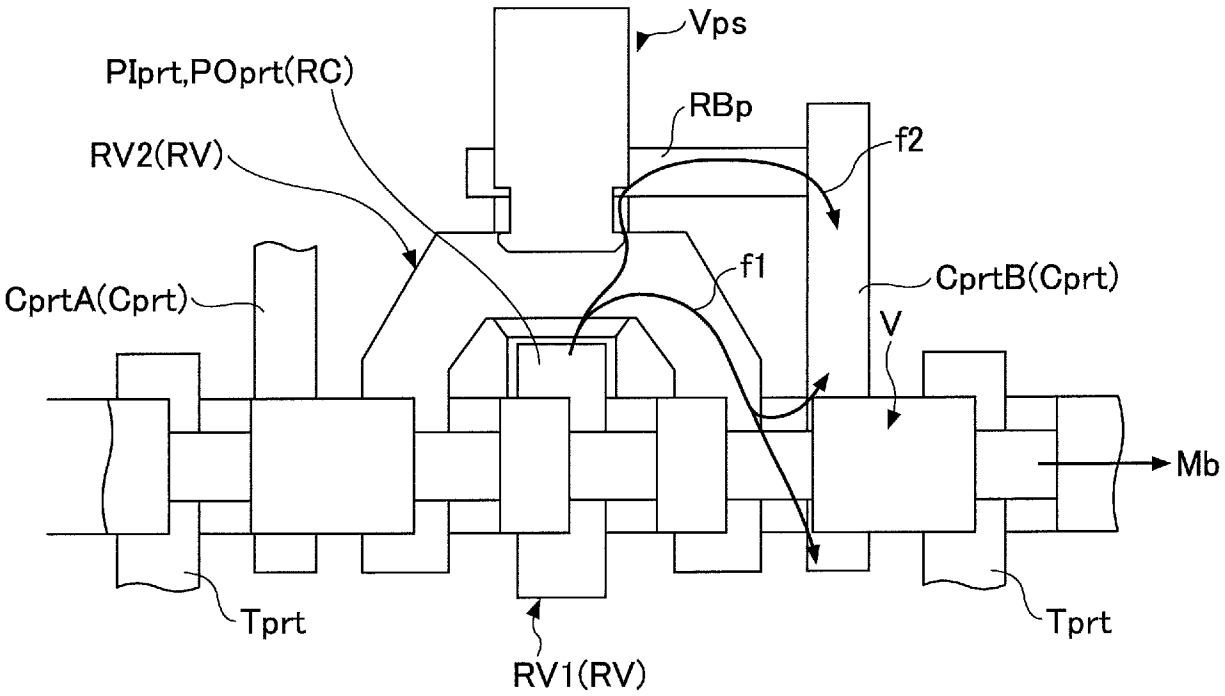
FIG. 3C schematically illustrates an exemplary directional control valve of the hydraulic circuit of the construction machine of the embodiment of the present invention.

Specifically, as illustrated in FIG. 3C, the directional control valve V of the embodiment supplies the pressurized oil (the operating oil) supplied from the center bypass passage RC through the bypass passage bypass passage RBp (f2 in FIG. 3B) and the opening of the spool (f1 in FIG. 3B) to the cylinder port CprtB (the hydraulic cylinder) when the bypass passage RBp is available (the bypass switching valve Vps is opened) in a case where the spool is displaced (Mb). Further, the hydraulic circuit 20 of the embodiment of the present invention may supply the pressurized oil from the center bypass passage RC to the cylinder port Cprt through only the bypass passage RBp (and the bypass switching valve Vps) in a case where the spool position is neutral (when the opening of the spool is closed).

In the hydraulic circuit 20 having the directional control valve group Gv (the multiple directional control valves V) arranged in it has a parallel passage of the multiple directional control valves V and the center bypass passage RC. As illustrated in, for example, FIG. 4, the hydraulic circuit 20 causes the pressurized oil Op supplied from the inlet port PIprt to flow through the first internal passage (RV1 illustrated in FIGS. 3A-3C) of the directional control valve V having substantially the same passage area regardless of the spool position of the directional control valve V to the outlet port POprt. The pressurized oil flows into the center bypass passage RC. With this, the shape of the center bypass passage RC can be simplified in the hydraulic circuit 20 of the hydraulic circuit 20 of the construction machine 100 of the embodiment of the present invention. Further, because the number of curved portions of the center bypass passage RC can be diminished in the hydraulic circuit 20 of the embodiment, the pressure loss of the pressurized oil passing through the center bypass passage RC can be reduced.

As described, in the hydraulic circuit 20 of the construction machine 100 of the embodiment of the present invention, because the bleed-off control is not performed in the directional control valve V (because the bleed opening is provided in the directional control valve V), the opening area of the first internal passage RV1 of the directional control valve V can be increased. Therefore, because the opening area of the first internal passage RV1 of the directional control valve V can be increased, the pressure loss of the pressurized oil passing through the center bypass passage RC can be decreased.

In the hydraulic circuit 20 of the embodiment, because the multiple directional control valves V are arranged in the center bypass passage RC in series, the parallel passage formed by the center bypass passage RC and the multiple first internal passages RV1 (the directional control valves V) functions. Therefore, because the parallel passage needs not to be separately provided in the hydraulic circuit 20, the directional control valve V can be miniaturized (the dimensions of the spool in the axial direction and the radius direction can be made small). In the hydraulic circuit 20, for example, a bridge passage Rb (FIG. 3A) can be miniaturized.

Further, in the hydraulic circuit 20 of the embodiment, the flow rate of the operating oil (the pressurized oil) supplied to the hydraulic cylinder (11*c*, etc.) is controlled using the bypass passage RBp (and the bypass switching valve Vps) so as to control a drive (an operation) of the hydraulic actuator (11, etc.). Further, in the hydraulic circuit 20, the pressurized oil supplied to the hydraulic actuator can be controlled independent from a control of a stroke of the directional control valve V. In the hydraulic circuit 20, for example, after exceeding a control range of the stroke of the directional control valve V, the bypass switching valve Vps can be used to control the pressurized oil supplied to the hydraulic actuator. Furthermore, in the hydraulic circuit 20, because the pressurized oil can be directly supplied to the hydraulic cylinder (the cylinder port Cprt) using the bypass passage RBp (and the bypass switching valve Vps) 20 without passing through the opening of the spool of the directional control valve V, the pressure loss of the pressurized oil to be supplied can be reduced.

Figure 5:
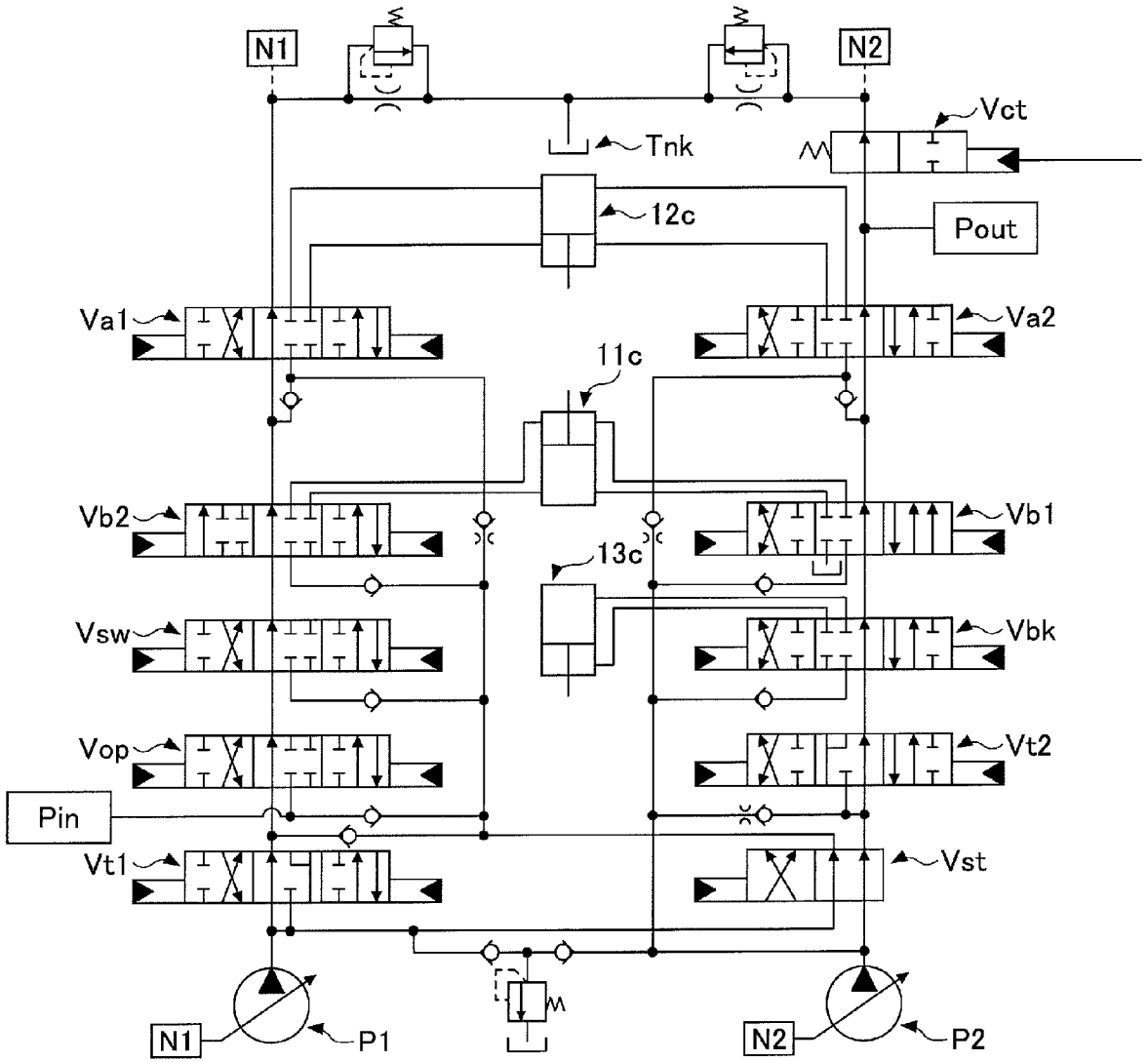
FIG. 5 illustrates a hydraulic circuit for illustrating another example of the hydraulic circuit of the construction machine.

Referring to FIG. 5, another example of the hydraulic circuit of the construction machine is illustrated. In the other example of the hydraulic circuit, in order to perform the bleed-off control, a bleed opening (e.g., Sbo illustrated in FIG. 6) is formed in the spool of the directional control valve (e.g., Va1 or the like). Said differently, the construction machine having the other example of the hydraulic circuit can perform the bleed-off control by changing the opening area of the bleed opening.

In the construction machine having the other example of the hydraulic circuit illustrated in FIG. 5, because the bleed opening is formed in the spool of the directional control valves, there is a case where the pressure loss of the pressurized oil passing through the center passage increases in comparison with a case of the hydraulic circuit (FIG. 2) of the embodiment of the present invention.

In the construction machine having the other example of the hydraulic circuit (FIG. 5), there may be a case where the pressure loss of the pressurized oil passing through the directional control valve is generated. In the construction machine having the other example of the hydraulic circuit, even in a case where the opening degree of the bleed opening of the directional control valve is at the upper limit, because the opening of the internal passage of the directional control valve is designed so as to be slightly choked, there is a case where the pressure loss of the pressurized oil passing through the center passage increases in comparison with the case of the hydraulic circuit (FIG. 2) of the embodiment of the present invention.

Further, because the bleed opening is provided in the spool of the directional control valve of the other example of the hydraulic circuit (FIG. 5), the length of the directional control valve in its longitudinal direction increases. Said differently, in the directional control valve of the other example of the hydraulic circuit, because the bleed opening is provided in the spool of the directional control valve, the size of the directional control valve becomes larger in comparison with the case of the hydraulic circuit (FIG. 2) of the embodiment of the present invention. Therefore, the manufacture of the directional control valve of the other example of the hydraulic circuit is not easy.

Further, in a case where the bypass passage (the bypass switching valve) bypassing the center bypass passage (RC) and the cylinder port (CprtBm) is further provided in the other example of the hydraulic circuit (FIG. 5), there is a case where the size of the spool of the directional control valve (Vm) (or the bridge passage Rbm) in its longitudinal direction becomes large. Further, in the other example of the hydraulic circuit, the shape or the like of the newly provided bypass passage (the bypass switching valve) is complicated, and there may be a case where the pressure loss of the pressurized oil supplied to the cylinder port increases. Said differently, in the other example of the hydraulic circuit, there may be a case where the size of the hydraulic circuit becomes large and the manufacture of the hydraulic circuit becomes easy in comparison with the case of the hydraulic circuit (FIG. 2).

(Control Device of Construction Machine)

A controller 30C (FIG. 2) for controlling the entire operation of the construction machine 100 is installed in the control device 30 of the construction machine 100 of the embodiment of the present invention. Here, the controller 30C (the control device 30) is provided to instruct operations to components of the construction machine 100 and controls the operations of the components. The controller 30C (the control device 30) may be structured by an arithmetic processing unit including a central processing unit (CPU), a memory (a ROM, a RAM, or the like), and so on.

Within the embodiment, the controller 30C of the embodiment controls the operation of a regulator R (R1, R2) based on information (for example, the operation amount and the operation direction of the operation lever) input in the construction machine 100. With this, the discharge amount of the hydraulic pump P (P1, P2) is controlled by the regulator R.

Further, the remote control pressure is generated by the controller 30C using the remote control valve or the like based on the information input in the construction machine 100. Subsequently, the controller 30C inputs the generated remote control pressure to the directional control valve (Vt1 or the like) using the remote control circuit. With this, the directional control valve can control the operating oil supplied to the hydraulic actuator by switching the position of the spool using the input remote control pressure.

The controller 30C changes the pressure of the pressurized oil of the pilot pump Pp (Pp1, Pp2) to be input in the bleed-off valve Vbo (Vbo1, Vbo2) through the electromagnetic pressure reducing valve or the like (not illustrated) based on the information input into the construction machine 100. With this, the opening degree of the bleed-off valve Vbo can be changed using the input pressure. Further, the bleed-off valve Vbo can control the flow rate of the pressurized oil flowing back to the operating oil tank by changing the opening degree Vbo.

Further, within the embodiment, the controller 30C controls the opening area of the bypass switching valve Vps (FIGS. 3A to 3C) based on the information input into the construction machine 100. The controller 30C controls the pressure of the pressurized oil of the pilot pump Pp (Pp1 and Pp2 illustrated in FIG. 2) to be input into, for example, a control port of the bypass switching valve Vps in order to change the opening area of the bypass switching valve Vps through the electromagnetic pressure reducing valve or the like (not illustrated). With this, the controller 30C can control the flow rate of the pressurized oil passing through the bypass passage RBp by changing the opening area of the bypass switching valve Vps. Said differently, the controller 30C can control the pressurized oil directly supplied to the cylinder port Cprt. The controller 30C may control the pressurized oil to be supplied to the cylinder port Cprt by changing the opening area of the bypass switching valve Vps when the pressurized oil is not supplied to the cylinder port Cprt through the opening of the spool of the directional control valve V.

As described above, according to the control device 30 of the construction machine 100 of the embodiment of the present invention, an effect similar to that of the above hydraulic circuit 20 is obtainable.

Example (Structure of Construction Machine), (Hydraulic Circuit of Construction Machine), and (Control Device of Construction Machine)

Because the structure or the like (FIGS. 1 to 4) of the example is basically similar to the structure or the like of the embodiment, an explanation of the structure or the like (FIGS. 1 to 4) of the examples is omitted.

(Directional Control Valve and Internal Passage of Directional Control Valve)

Figure 8:
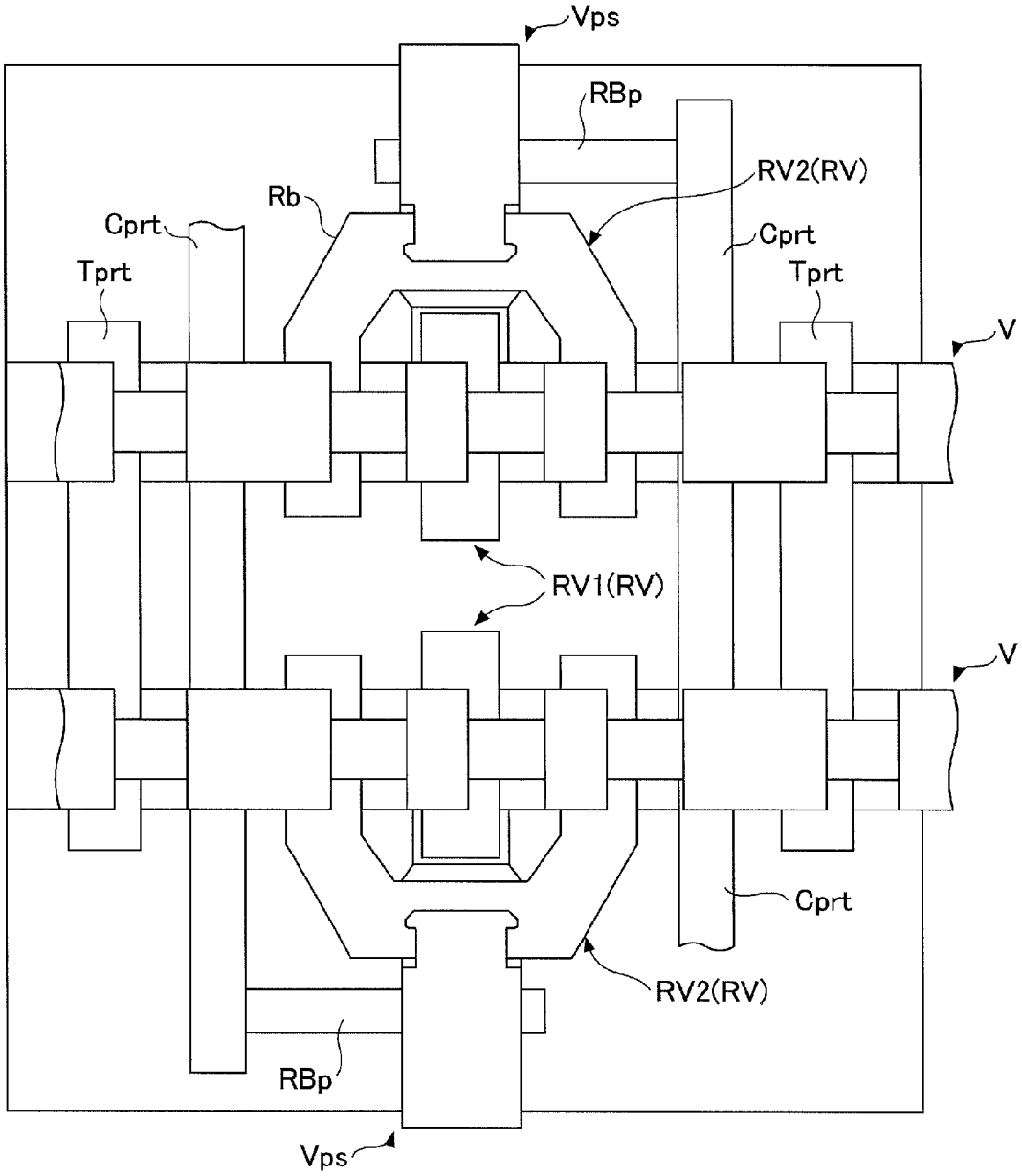
FIG. 8 illustrates a schematic structure of an exemplary directional control valve of the hydraulic circuit of the construction machine of the embodiment of the present invention.

An exemplary directional control valve (the control valve) arranged in the hydraulic circuit 20 of the construction machine 110 is illustrated in FIG. 8.

As illustrated in FIG. 8, in the hydraulic circuit 20 of the example, multiple directional control valves V are arranged on a plane vertical to the center bypass passage RC. With this, in the hydraulic circuit 20, the multiple directional control valves V of the directional control valve group Gv (FIG. 4), which are arranged in tandem, can be arranged at positions corresponding to the cylinder port Cprt (the hydraulic actuator), respectively. Said differently, the hydraulic circuit 20 can optimally design the shape, the length, the wiring, or the like of the oil passage (RC, RBp, or the like illustrated in FIG. 2).

Further, in the hydraulic circuit 20 of the example, the bypass passages RBp (and the bypass switching valves Vps) are arranged in the multiple directional control valves V arranged on the plane vertical to the center bypass passage RC, respectively. With this, the hydraulic circuit 20 can individually control the pressurized oil supplied from the multiple directional control valves V arranged on the plane vertical to the center bypass passage RC to the cylinder ports Cprt.

The hydraulic circuit applicable to the present invention is not limited to a circuit in which two directional control valves V are arranged on the same plane vertical to the center bypass passage RC illustrated in FIG. 8. Said differently, the hydraulic circuit applicable to the present invention may be configured such that at least three directional control valves V are arranged on the same plane vertical to the center bypass passage RC.

As described, the effect of the hydraulic circuit 20 of the construction machine 110 of the example of the present invention can be similar to the effect of the hydraulic circuit 20 of the construction machine 110 of the embodiment of the present invention.

Heretofore, preferred embodiments of the present invention are described for the hydraulic circuit of the construction machine and the control device for the construction machine. However, the present invention is not limited to the above described embodiments and the example. Further, the present invention can be variously modified or changed in the light of attached scope of claims.

For example, reference symbols designate as follows:

100, 110: construction machine;
11: boom;
11*c*: boom cylinder;
12: arm;
12*c*: arm cylinder;
13: bucket;
13*c*: bucket cylinder;
20: hydraulic circuit;
30: control device;
30C: controller;
Gv: directional control valve group;
V: directional control valve (control valve);
Va1, Va2, Vb1, Vb2, Vbk, Vsw, Vop, Vt1, Vt2: directional control valve for hydraulic actuator;
Vst: directional control valve for straight travel (straight travel valve);
Vbo: bleed-off valve (cut valve);
Vps: bypass switching valve;
Vch: check valve (check valve);
RC, RC1, RC2: center bypass passage (center bypass line);
RV1: first internal passage (internal passage inside bleed-off, internal passage for PT opening)
RV2: second internal passage (internal passage for hydraulic actuator, internal passage for cylinder port);
RBp: bypass passage;
PIprt: inlet port;
POprt: outlet port;
Tprt: tank port;
Cprt, CprtA, CprtB: cylinder port;
P, P1, P2: hydraulic pump
R, R1, R2: regulator;
Tnk: operating oil tank (tank); and
Pp, Pp1, Pp2: pilot pump.

It should be understood that the invention is not limited to the above-described embodiment, but may be modified into various forms on the basis of the spirit of the invention. Additionally, the modifications are included in the scope of the invention.

What is claimed is:

1. A hydraulic circuit for a construction machine including a center bypass passage, into which a pressurized oil discharged from a hydraulic pump is supplied, the hydraulic circuit comprising:

a directional control valve group including a plurality of directional control valves arranged in tandem with the center bypass passage; and a bleed-off valve arranged in the center bypass passage on a downstream side of the directional control valve group, wherein each directional control valve includes a first internal passage for causing the pressurized oil supplied to the directional control valve to flow out to the center bypass passage and a second internal passage for supplying the pressurized oil to a cylinder port, wherein a parallel passage is formed by the center bypass passage and the first internal passage by causing, by the first internal passage, the pressurized oil discharged from the hydraulic pump to flow out to the center bypass passage on the downstream side of the directional control valve, wherein the second internal passage supplies the pressurized oil along at least one flow path among a flow path from the center bypass passage through a spool opening to the cylinder port and a flow path from the center bypass passage through a bypass passage to the cylinder port, wherein a bypass switching valve is arranged in the bypass passage, and wherein the bypass switching valve controls a flow rate of the pressurized oil supplied to the cylinder port through the bypass passage by changing an opening area of the bypass switching valve.

2. The hydraulic circuit for the construction machine according to claim 1, wherein a passage area of the first internal passage is unchanged regardless of a position of the spool of each directional control valve and forms the parallel passage corresponding to the passage area, wherein the pressurized oil is supplied to the plurality of directional control valves only through the parallel passage.

3. The hydraulic circuit for the construction machine according to claim 1, wherein the directional control valve group includes a plurality of directional control valve groups, and the center bypass passage includes a plurality of center bypass passages, wherein the plurality of directional control valve groups are arranged in the plurality of center bypass passages, respectively, wherein a plurality of the parallel passage are formed by the plurality of center bypass passages and the first internal passages of the plurality of the directional control valve groups, respectively.

4. A control device for controlling a hydraulic circuit for a construction machine, wherein the hydraulic circuit for the construction machine is the hydraulic circuit for the construction machine according to claim 1.

5. A control device for controlling a hydraulic circuit for a construction machine, wherein the hydraulic circuit for the construction machine is the hydraulic circuit for the construction machine according to claim 1, wherein the opening area of the bypass switching valve is changed in response to operation information input into the construction machine.

* * * * *